US007787803B2

(12) United States Patent
Ahn et al.

(10) Patent No.: US 7,787,803 B2
(45) Date of Patent: Aug. 31, 2010

(54) IMAGE FORMING APPARATUS HAVING CONTROLLER TO SELECTIVELY CONTROL PLURALITY OF DRIVING SOURCES

(75) Inventors: Byung-sun Ahn, Suwon-si (KR); Kyung-shig Chung, Suwon-si (KR); Byeong-hwa Ahn, Seongnam-si (KR); Soo-yong Kim, Seoul (KR); Gi-cheol Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 287 days.

(21) Appl. No.: 11/938,976

(22) Filed: Nov. 13, 2007

(65) Prior Publication Data

US 2008/0118274 A1 May 22, 2008

(30) Foreign Application Priority Data

Nov. 22, 2006 (KR) ..... 10-2006-0116101
May 31, 2007 (KR) ..... 10-2007-0053383

(51) Int. Cl.
*G03G 15/00* (2006.01)

(52) U.S. Cl. ..... 399/167

(58) Field of Classification Search ..... 399/130, 399/159, 167, 297, 298, 299, 306, 308, 309
See application file for complete search history.

(56) References Cited

U.S. PATENT DOCUMENTS 5,819,149 A 10/1998 Watanabe et al.
6,173,141 B1 * 1/2001 Sakagami et al. ..... 399/167
6,889,022 B2 * 5/2005 Ehara et al. ..... 399/167
7,366,444 B2 * 4/2008 Takane ..... 399/167
2004/0076457 A1 4/2004 Chung
2004/0223785 A1 11/2004 Abe
2005/0214050 A1 9/2005 Carter et al.
2006/0093419 A1 5/2006 Kitamura

FOREIGN PATENT DOCUMENTS

JP 58-87068 5/1983
JP 2005-215229 8/2005
KR 1999-20249 3/1999
KR 1999-29289 7/1999
KR 1999-56048 7/1999

OTHER PUBLICATIONS

European Search Report dated Mar. 10, 2008 issued in EP 07121238.5.

* cited by examiner

*Primary Examiner*—Hoan Tran
(74) *Attorney, Agent, or Firm*—Stanzione & Kim, LLP

(57) ABSTRACT

An image forming apparatus includes a developing unit to form an image using a developing agent on one side of a printing medium transported along a simplex printing path, a fixing unit to fix the developing agent on the printing medium, a discharging roller to discharge the printing medium that passes the fixing unit, and a first driving source to drive the developing unit, the fixing unit and the discharging roller.

17 Claims, 8 Drawing Sheets

IMAGE FORMING APPARATUS HAVING CONTROLLER TO SELECTIVELY CONTROL PLURALITY OF DRIVING SOURCES

CROSS-REFERENCE TO RELATED APPLICATIONS

This application claims priority under 35 U.S.C. §119(a) from Korean Patent Applications No. 10-2006-0116101, filed on Nov. 22, 2006 and No. 10-2007-0053383, filed on May 31, 2007 in the Korean Intellectual Property Office, the disclosures of which are incorporated herein in their entirety by reference.

BACKGROUND OF THE INVENTION

1. Field of the Invention

The present general inventive concept relates to an image forming apparatus, more particularly, to an image forming apparatus in which stress on a toner and power consumption are reduced.

2. Description of the Related Art

Referring to FIG. 1, a conventional electrophotographic image forming apparatus 1 includes a feeding unit 10, a transport unit 20, developing units 30C, 30M, 30Y and 30K which each store predetermined colors of toners, a plurality of transfer rollers 40, a light scanning unit (LSU) 43, a fixing unit 50 and a discharging unit 60. A printing medium which is stacked on a knockup plate 12 elastically supported by a spring 11 is picked up by a pickup roller 13 and its leading edge is aligned by a registration roller 14. The aligned printing medium is transported by a transport belt 25 of the transport unit 20 to the developing units 30, and a color toner image is formed on the printing medium via the developing units 30C, 30M, 30Y and 30K. The color toner image formed on the printing medium is fixed with heat and pressure by a heat roller 53 and a press roller 55. The printing medium which is completed in printing via the fixing unit 50 is discharged by a discharging roller 63 to the outside.

However, the conventional image forming apparatus 1 uses eight motors, four of which are to drive the fixing unit 50, a transport belt driving roller 27, the discharging roller 63 and the pickup roller 13 respectively, and the other four to drive the respective developing units 30C, 30M, 30Y and 30K. Further, the driving motors (not illustrated) for the developing units 30C, 30M, 30Y and 30K drive photosensitive drums 35C, 35M, 35Y and 35K, developing rollers 33C, 33M, 33Y and 33K, and agitators (not illustrated), respectively, and transmission of power from the driving motors to the developing rollers 33C, 33M, 33Y and 33K and the agitators is controlled by a solenoid.

Thus, using eight motors, the conventional image forming apparatus 1 has a complicated structure to transmit power, consumes more electric power, and increases manufacturing cost and a driving noise. Also, when the image forming apparatus 1 prints black and white images, though power in the developing rollers and the agitators is controlled by the solenoid, the photosensitive drums are still being driven. Accordingly, stress on the toner may increase.

SUMMARY OF THE INVENTION

Accordingly, the present general inventive concept to provide an image forming apparatus which has a simple structure to transmit power.

The present general inventive concept is to provide an image forming apparatus in which a driving noise is reduced.

The present general inventive concept is to provide an image forming apparatus in which stress on a toner is decreased.

The present general inventive concept is to provide an image forming apparatus which is effective to reduce manufacturing cost.

The present general inventive concept is to provide an image forming apparatus which consumes less electric power.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus including a developing unit to form an image using a developing agent on one side of a printing medium transported along a simplex printing path, a fixing unit to fix the developing agent on the printing medium, a discharging roller to discharge the printing medium that passes the fixing unit, and a first driving source to drive the developing unit, the fixing unit and the discharging roller.

According to an aspect of the general inventive concept, the image forming apparatus may further include a developing unit power transmission unit to selectively transmit power from the first driving source to the developing unit.

The image forming apparatus may further include a fixing unit power transmission unit to selectively transmit power from the first driving source to the fixing unit.

The developing unit may be provided in plural, and the respective developing units may store different colors of developing agents, and each of the developing units may include a photosensitive body, a developing roller to develop the photosensitive body with the developing agent and an agitator to agitate the developing agent.

The developing units may include a mono developing unit disposed adjacent to the fixing unit among the developing units and to store a black developing agent, and the first driving source may drive the developing roller and the agitator which may be in the mono developing unit.

The image forming apparatus may further include a second driving source to rotatably drive all the photosensitive bodies of the developing units.

The image forming apparatus may further include a plurality of transfer rollers disposed parallel with the photosensitive bodies with a printing medium interposed between the transfer rollers and the photosensitive bodies, and a transport unit to transport the printing medium between the photosensitive bodies and the transfer rollers and may be driven by the second driving source.

The developing units may include a color developing unit to store a color developing agent, and the image forming apparatus may further include a third driving source to drive the developing roller and the agitator which may be in the color developing unit.

The image forming apparatus may further include a duplex guide to guide the printing medium from the discharging roller to the developing unit so that an other side of the printing medium is to be printed, wherein the discharging roller is provided to be rotatable in forward and backward directions to transport the printing medium to the duplex guide.

The image forming apparatus may further include a duplex printing sensor to sense whether the printing medium is transported to the duplex guide.

The duplex printing sensor may sense whether the printing medium passes the fixing unit.

The duplex printing sensor nay include a first lever interposed between the fixing unit and the discharging roller to rotate while contacting with a printing medium which passes the fixing unit, a second lever to rotate by interlocking with the first lever and to rotate while contacting a printing medium which progresses by a backward rotation of the discharging roller, and a sensor to sense a position of at least one of the first and second levers.

The image forming apparatus may further include a controller to control the first driving source to rotate the discharging roller in forward and backward directions according to a result sensed by the duplex printing sensor in a duplex printing mode.

The image forming apparatus may further include a pair of registration rollers disposed in front of the developing units with respect to the simplex printing path and driven by the second driving source, and a controller to control at least one of the second and third driving sources not to operate after the printing medium completely passes the fixing unit, before the printing medium is caught again by the registration rollers.

The image forming apparatus may further include a controller to control at least one of the second and third driving sources not to operate while the discharging roller rotates in a backward direction, if duplex printing is requested.

The image forming apparatus may further include a controller to determine whether printing data for an other side of a printing completed side of the printing medium corresponds to data to be printed in a black and white printing mode in a duplex printing mode.

The controller may control the third driving source not to operate from a time when the one side of the printing medium passes the fixing unit and completes printing to a time when the other side of the printing medium is printed and the printing medium is discharged, if the printing data corresponds to data to be printed in the black and white printing mode.

The image forming apparatus may further include a controller to determine whether printing data corresponds to data to be printed in a black and white mode and to control the third driving source not to operate, if the printing data corresponds to the data to be printed in the black and white mode.

The foregoing and/or other aspects and utilities of the present general inventive concept can also be achieved by providing an image forming apparatus including a mono developing unit which includes a first photosensitive body, a developing agent storage unit to store a black developing agent, and a first rotating body to supply the black developing agent to the first photosensitive body, a color developing unit which includes a second photosensitive body, a developing agent storage unit to store a color developing agent, and a second rotating body to supply the color developing agent to the second photosensitive body, a fixing unit to fix the black and color developing agents on a printing medium, a discharging roller to discharge the printing medium passing the fixing unit, a first driving source to drive the first rotating body, the fixing unit and the discharging roller, a second driving source to drive the first and second photosensitive bodies, and a third driving source which drives the second rotating body.

The image forming apparatus may further include a transport belt to circulate to transport the printing medium to the photosensitive bodies, a plurality of transfer rollers disposed parallel to the first and second photosensitive bodies with the transport belt interposed between the transfer rollers and the photosensitive bodies and to transfer the black and color developing agents to the printing medium transported by the transport belt, and a driving roller driven by the second driving source and drives the transport belt.

The discharging roller may be provided to be rotatable in forward and backward directions, and the image forming apparatus may further include a duplex guide to guide the printing medium from the discharging roller to the color developing unit.

The image forming apparatus may further include a controller to control the first driving source to rotate the discharging roller in a backward direction to transport the printing medium which passes the fixing unit to the duplex guide in a duplex printing mode.

The controller may control at least one of the second and third driving sources not to operate while the discharging roller rotates in the backward direction.

The foregoing and/or other aspects and utilities of the present general inventive concept may also be achieved by providing an image forming apparatus, comprising a mono developing unit, a color developing unit, a plurality of driving sources to respectively drive one or more of the mono developing unit and the color developing unit, and a controller to selectively control the plurality of driving sources based one or more of a type of printing mode selected, wherein the type of printing mode includes a duplex printing mode, a simplex printing mode, a color printing mode, and a black and white printing mode.

The foregoing and/or other aspects and utilities of the present general inventive concept may also be achieved by providing a method of operating an image forming apparatus, the method comprising driving one or more of a plurality of driving sources to respectively drive one or more of a mono developing unit and a color developing unit; and selectively controlling the plurality of driving sources based on a selection of one or more of a duplex printing mode, a simplex printing mode, a color printing mode, and a black and white printing mode.

The foregoing and/or other aspects and utilities of the present general inventive concept may also be achieved by providing a computer-readable recording medium having embodied thereon a computer program to execute a method, wherein the method comprises driving one or more of a plurality of driving The foregoing and/or other aspects and utilities of the present general inventive concept may also be achieved by providing sources to respectively drive one or more of a mono developing unit and a color developing unit, and selectively controlling the plurality of driving sources based on a selection of one or more of a duplex printing mode, a simplex printing mode, a color printing mode, and a black and white printing mode.

BRIEF DESCRIPTION OF THE DRAWINGS

These and/or other aspects and utilities of the present general inventive concept will become apparent and more readily appreciated from the following description of the embodiments, taken in conjunction with the accompanying drawings, in which.

DETAILED DESCRIPTION OF THE PREFERRED EMBODIMENTS

Figure 1:
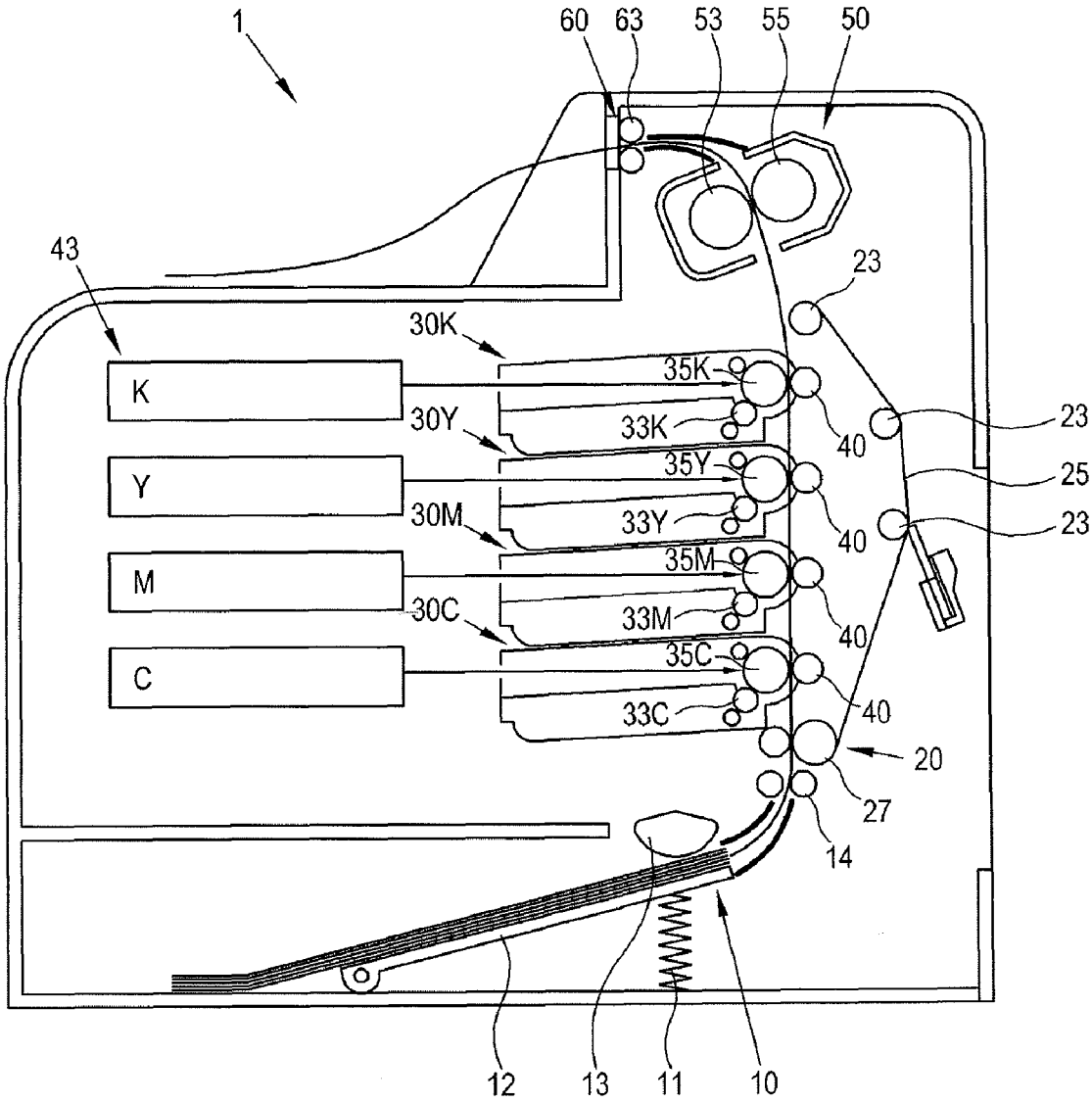
FIG. 1 (CONVENTIONAL ART)
FIG. 1 is a cross-sectional view illustrating a conventional image forming apparatus.

Reference will now be made in detail to embodiments of the present general inventive concept, examples of which are illustrated in the accompanying drawings, wherein like reference numerals refer to like elements throughout. The embodiments are described below in order to explain the present general inventive concept by referring to the figures.

Figure 2:
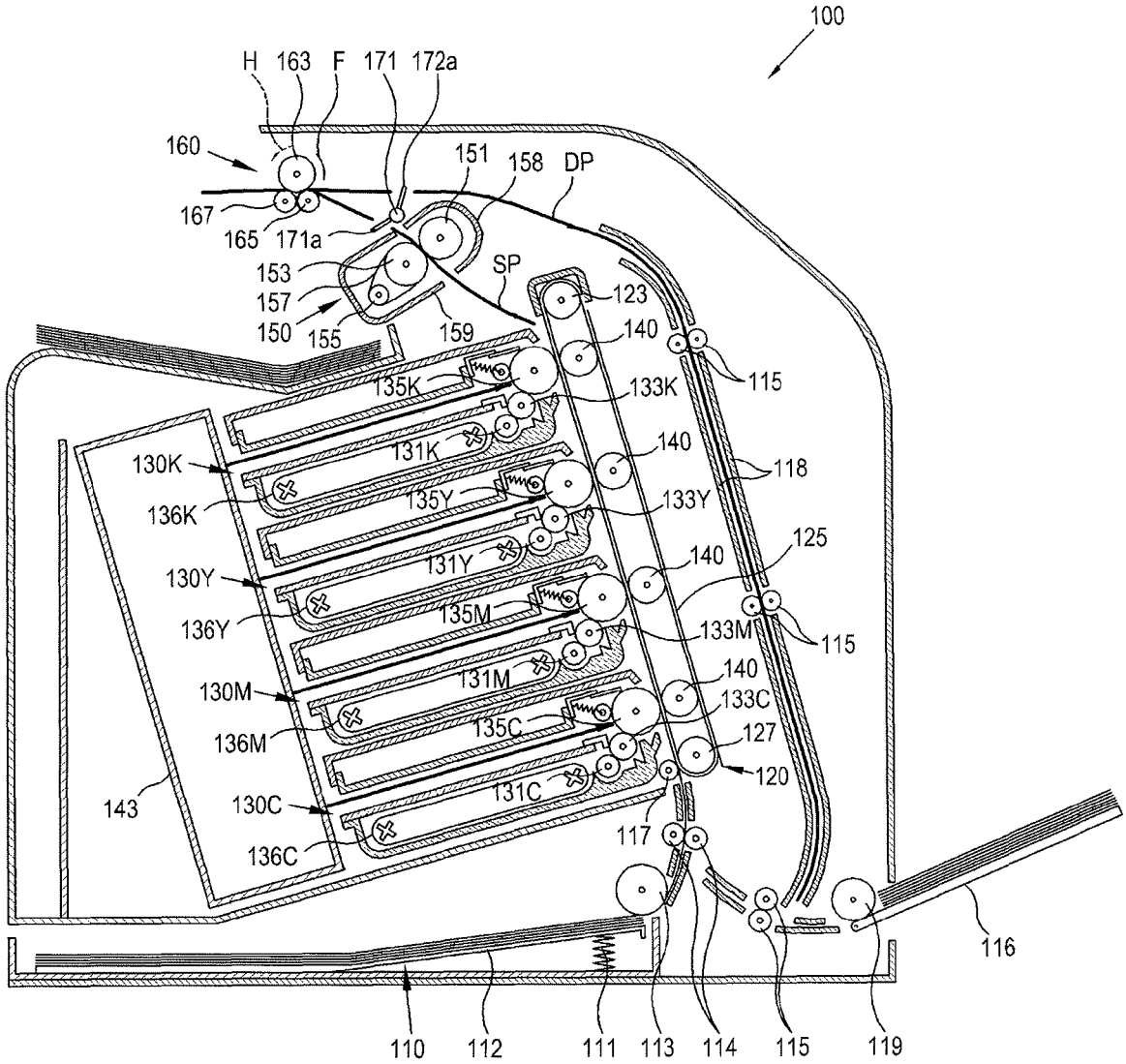
FIG. 2 is a schematic cross-sectional view illustrating an image forming apparatus according to an exemplary embodiment of the present general inventive concept.

Referring to FIG. 2, an image forming apparatus 100 according to an exemplary embodiment of the present general inventive concept includes a feeding unit 110, a transport unit 120, a plurality of developing units 130C, 130M, 130Y and 130K, an exposure unit 143, a fixing unit 150 and a discharging unit 160.

The developing units 130C, 130M, 130Y and 130K, a plurality of transfer rollers 140 and the fixing unit 150 are disposed along a simplex printing path SP from a registration roller 114 to a discharging roller 163, and an image is formed on a printing medium while passing through the simplex printing path SP.

The feeding unit 110 includes a knockup plate 112, an elastic member 111 and a pickup roller 113. A printing medium which is stacked on the knockup plate 112 elastically supported by the elastic member 111 and is picked up by the pickup roller 113, is transported toward the registration roller 114. In addition, the feeding unit 110 may further include a manual cassette 116 to manually feed a printing medium and a manual pickup roller 119 to pick up a printing medium on the manual cassette 116.

Meanwhile, a leading edge of the printing medium which is aligned by the registration roller 114, is charged with a predetermined electric charge by a charging roller 117 to be attached to a transport belt 125, thereby being transported between the photosensitive drum 135Y of the developing unit 130Y and the transfer roller 140.

The transport unit 120 includes the transport belt 125, a transport belt driving roller 127 and a driven roller 123 to drive the transport belt 125. The transport belt 125 is circulated endlessly by the transport belt driving roller 127 and the driven roller 123. The transport belt 125 may be provided as a conductive belt so that a charged printing medium may be attached thereto.

The developing units 130Y, 130M, 130C and 130K include photosensitive bodies 135Y, 135M, 135C and 135K, supplying rollers 131Y, 131M, 131C and 131K, developing rollers 133Y, 133M, 133C and 133K and developing agent storage units 136Y, 136M, 136C and 136K to store a developing agent, respectively.

The developing units 130Y, 130M, 130C and 130K may be provided detachably to the image forming apparatus 100. As necessary, the components of the developing units 130Y, 130M, 130C and 130K except for the photosensitive bodies 135Y, 135M, 135C and 135K may be provided detachably to the image forming apparatus 100.

The developing agent storage units 136Y, 136M, 136C and 136K store a yellow (Y) developing agent, a magenta (M) developing agent, a cyan (C) developing agent and a black (K) developing agent, respectively. The supplying rollers 131Y, 131M, 131C and 131K supply the developing agents stored in the developing agent storage units 136Y, 136M, 136C and 136K to the developing rollers 133Y, 133M, 133C and 133K. Then, the developing rollers 133Y, 133M, 133C and 133K supply the developing agents to the respective photosensitive bodies 135Y, 135M, 135C and 135K, thereby developing electrostatic latent images formed on the photosensitive bodies 135Y, 135M, 135C and 135K.

If a surface of the photosensitive body 135 is exposed by the exposure unit 143 to be formed into an exposed region and an unexposed region, a potential difference are generated between the regions, thereby forming the electrostatic latent images.

The exposure unit 143 exposes the photosensitive bodies 135Y, 135M, 135C and 135K so that electrostatic latent images corresponding to printing datum of colors such as yellow, magenta, cyan and black are formed on the photosensitive bodies 135Y, 135M, 135C and 135K, respectively. That is, the exposure units 143 expose only a portion of the surface of the photosensitive body 135C which is to be applied with a toner of cyan color, thereby forming an electrostatic latent image corresponding to image information of the cyan color. The electrostatic latent image is developed with a cyan developing agent by the supplying roller 131C and the developing roller 133C.

Accordingly, a visible image of the cyan developing agent is formed on the surface of the photosensitive body 135, and the visible image is transferred to a printing medium on the transport belt 125 by the transfer roller 140. Then, the printing medium with the cyan developing agent passes between the developing units 130M, 130Y and 130K which store developing agent of different colors, and the transfer roller 140 along the transport belt 125 so that toners of magenta, yellow and black colors are overlapped with each other thereon. Thus, a color image is formed on the printing medium.

The color image is fixed on the printing medium by heat and pressure while the printing medium passes the fixing unit 150. The printing medium in which the printing of one side is completed by passing the printing medium through the fixing unit 150 is discharged by the discharging unit 160 to the outside.

The discharging unit 160 includes the discharging roller 163 and idle rollers 165 and 167.

The fixing unit 150 includes a press roller 151, a fixing belt 157, a fixing belt driving roller 153, and an idle roller 155 which circulates the fixing belt 157 along a track with the fixing belt driving roller 153. The press roller 151, the fixing belt 157, the fixing belt driving roller 153 and the idle roller 155 may be accommodated in fixing frames 158 and 159.

The press roller 151 elastically presses the fixing belt driving roller 153 with the fixing belt 157 interposed therebetween and is driven by the fixing belt 157. A heater (not illustrated) is provided in the fixing belt driving roller 153 to heat the fixing belt 157 at a predetermined fixing temperature.

Accordingly, a printing medium interposed between the fixing belt 157 and the press roller 151 is applied with heat and pressure, thereby fixing a developing agent on the printing medium.

Figure 6:
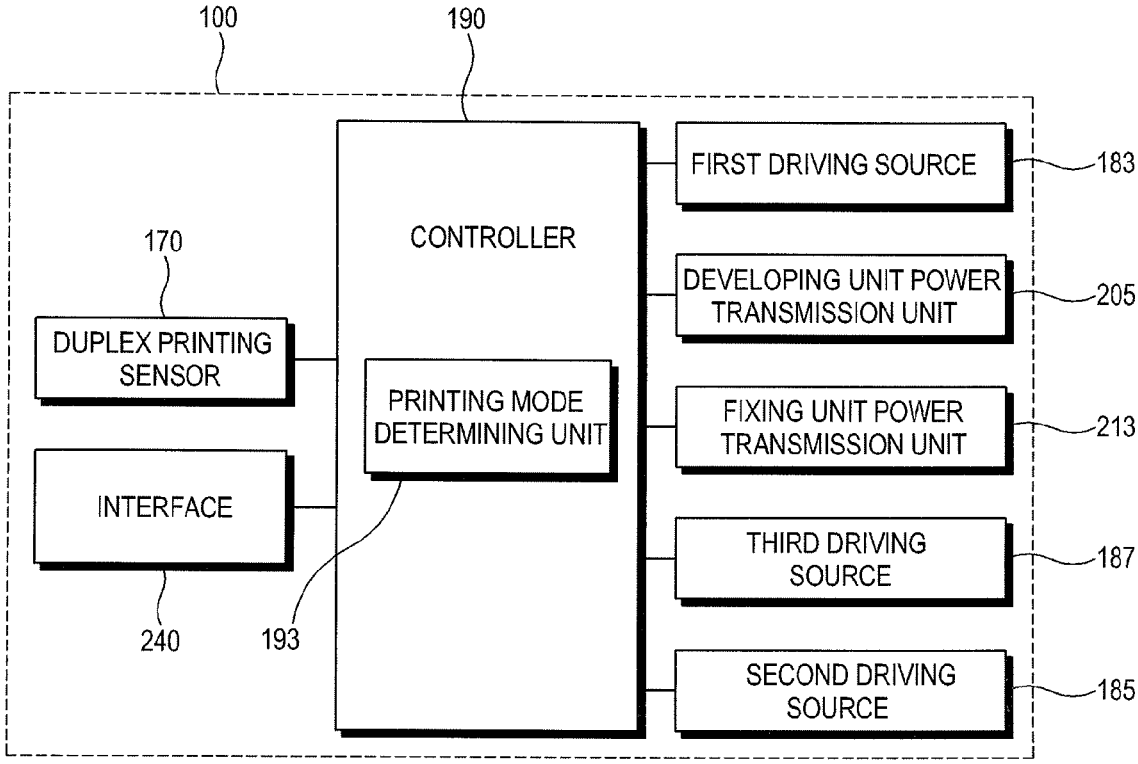
FIG. 6 is a block diagram illustrating the image forming apparatus according to the exemplary embodiment of the present general inventive concept.

Meanwhile, the image forming apparatus 100 according to the exemplary embodiment of the present general inventive concept further includes a first driving source 183, as illustrated in FIG. 6.

Figure 4:
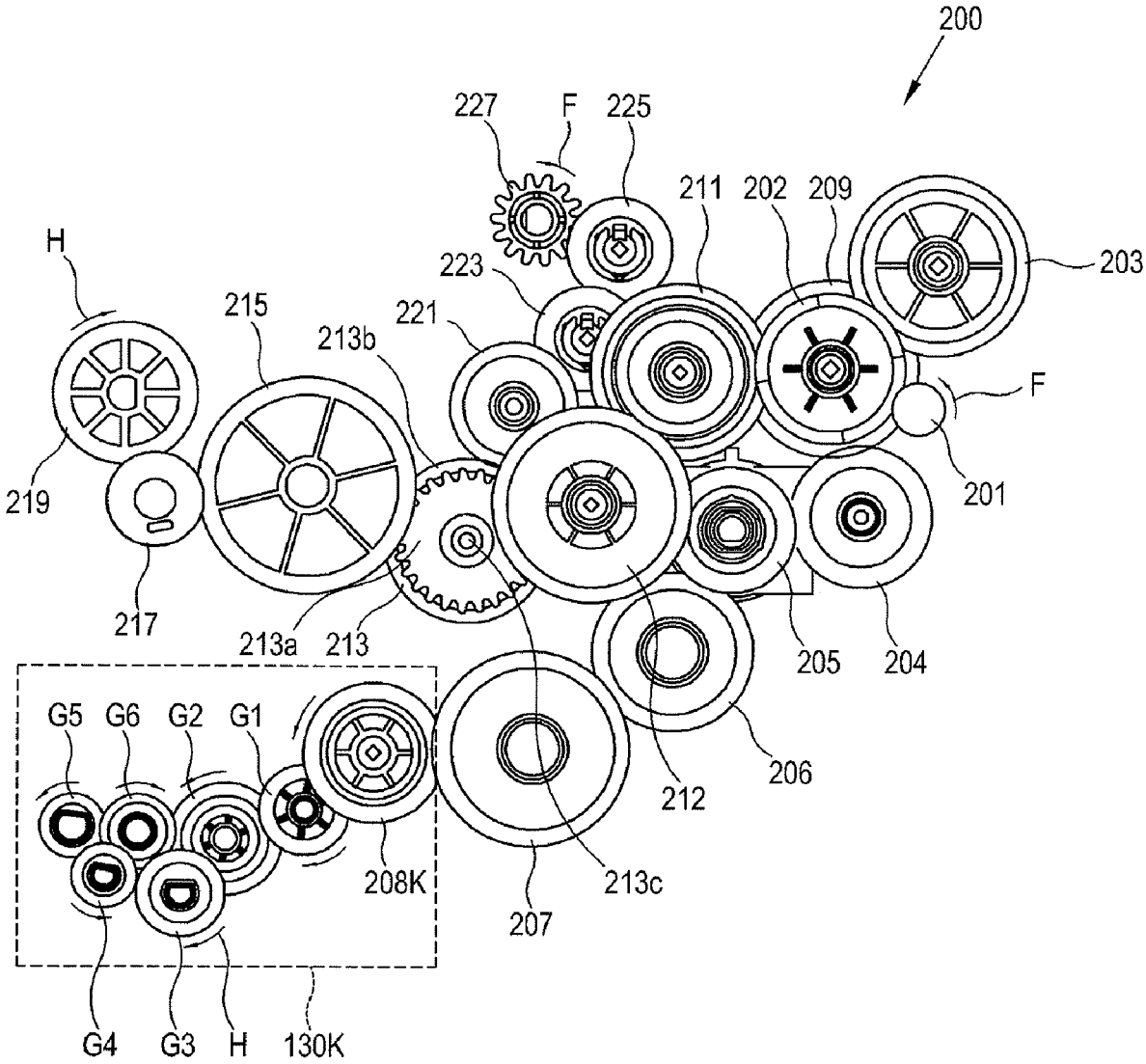
FIG. 4 is a plan view illustrating a main portion of a power transmitting apparatus in the image forming apparatus according to the exemplary embodiment of the present general inventive concept.
Figure 5:
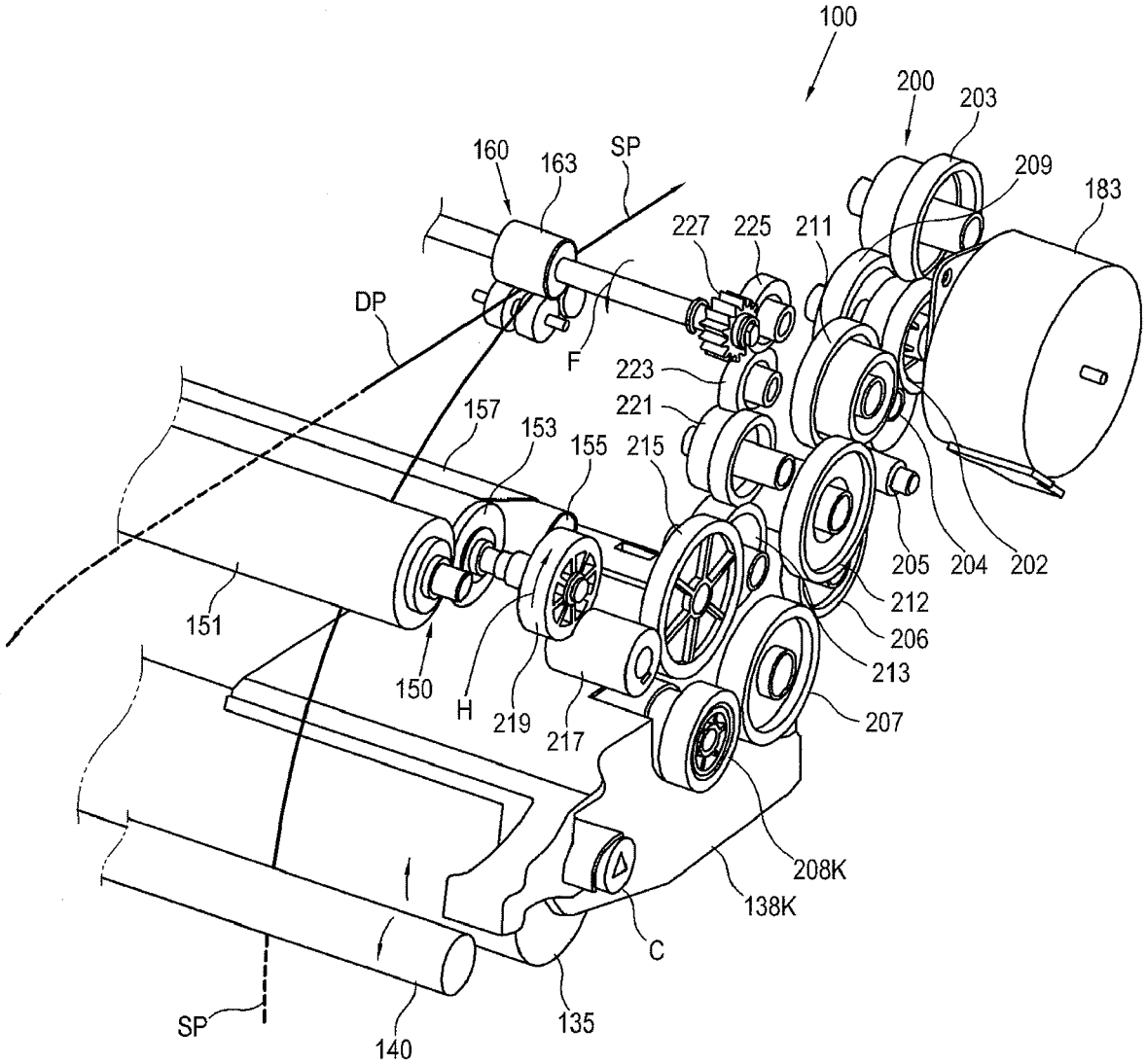
FIG. 5 is a perspective view illustrating the power transmitting apparatus in the image forming apparatus according to the exemplary embodiment of the present general inventive concept.

As illustrated in FIGS. 4 and 5, the first driving source 183 is a power source to drive the mono developing unit 130K, the fixing unit 150 and the discharging roller 163. In detail, the first driving source 183 is a power source to drive the developing roller 133K and the supplying roller 131K of the mono developing unit 130K to store the black developing agent, the fixing belt driving roller 153 of the fixing unit 150, and the discharging roller 163. The first driving source 183 may be provided as a stepping motor. Alternatively, the first driving source 183 may be provided as various types of electronic motors.

Meanwhile, the image forming apparatus 100 may further include a duplex guide 118 to form a duplex printing path DP where the printing medium in which printing on one side is completed and is transported to the developing unit 130 so that the other side of the printing medium can be printed.

The duplex guide 118 leads a printing medium to return to the developing unit 130C from the discharging unit 160. As illustrated in FIG. 2, the duplex guide 118 guides the printing medium to the registration roller 114, so that the duplex printing path DP joins the simplex printing path SP. Also, a pair of duplex rollers 115 is disposed at several positions of the image forming apparatus 100 to transport a printing medium along the duplex guide 118.

The discharging roller 163 is provided to transport a printing medium to the duplex guide 118 in an opposite direction to a discharging direction leading to the outside in order to print on the other side of the printing medium. Thus, the discharging roller 163 may be provided to be rotatable in forward and backward directions.

Referring to FIGS. 4 and 5, the image forming apparatus 100 further includes a power transmitting apparatus 200 to transmit power from the first driving source 183 to the mono developing unit 130K, the fixing unit 150 and the discharging roller 163.

For one driving source to drive the mono developing unit 130K, the fixing unit 150 and the discharging roller 163, power transmission units 205 and 213 may be provided on a mono developing unit power transmitting path where power is transmitted from the first driving source 183 to the mono developing unit 130K and a fixing unit power transmitting path where power is transmitted from the first driving source 183 to the fixing unit 150. In order to perform duplex printing, the discharging roller 163 should be rotatable in forward and backward directions, while the fixing unit 150 and the mono developing unit 130K may be rotatable in one direction due to a constant progressing direction of a printing medium.

A power transmitting path to the mono developing unit 130K by the power transmitting apparatus 200 is as follows. Referring to FIG. 4, a developing unit gear 208K is exposed to an outside of a casing 138K of the mono developing unit 130K so as to be transmitted with power from the outside. The developing unit gear 208K transmits power to a plurality of gears G1 through G6 which are accommodated in the casing 138K.

A power transmitting path from a driving pinion 201 connected to a driving shaft (not illustrated) of the first driving source 183 to the developing unit gear 208K is as follows.

Power is transmitted from the driving pinion 201 to the developing unit gear 208K via gears 202, 203, 209 and 204, the developing unit power transmission unit 205 and gears 206 and 207. The developing unit gear 208K is disposed in the mono developing unit 130K to be detachable to the image forming apparatus 100 in a single body with the developing unit 130K. Thus, when the developing unit 130K is attached to or detached from the image forming apparatus 100, the developing unit gear 208K engages with or is disengaged from the gear 207. Further, power transmission from the developing gear 208K to the developing roller gear G5 connected to a shaft of the developing roller 133K is performed via gears G1, G2 and G6 in order. Accordingly, when the driving pinion 201 rotates in a forward direction F, the developing roller 133K rotates in the forward direction F.

Also, power transmission from the developing unit gear 208K to the feeding roller gear G4 connected to a shaft of the supplying roller 131K is performed via gears G1, G2 and G6 in order. Accordingly, the supplying roller 131K rotates in the same forward direction F as the developing roller 133K. Thus, the supplying roller 131K and the developing roller 133K rotate in the same direction, thereby frictionally charging developing agents accommodated therein with electricity.

Power transmission from the developing unit gear 208K to the agitator gear G3 connected to a shaft of the agitator (not illustrated) is performed via gears G1 and G2 in order. Accordingly, the agitator rotates in a backward direction H and is allowed to transport a developing agent to the supplying roller 131K.

Meanwhile, the developing unit power transmission unit 205 is provided as a one-way gear, thereby transmitting power to the mono developing unit 130K when the driving pinion 201 rotates in the forward direction, but blocking power thereto when the driving pinion 201 rotates in the backward direction. Alternatively, the developing unit power transmission unit 205 may be provided as any known power transmission unit such as an electronic clutch, a swing gear, a latch gear, etc.

Meanwhile, the power transmitting path to the fixing unit 150 by the power transmitting apparatus 200 is as follows.

Referring to FIGS. 4 and 5, power transmission from the driving pinion 201 to a fixing unit gear 219 connected to the fixing belt driving roller 153 is performed via gears 202, 211 and 212, a first gear train 213*a* of the fixing unit power transmission unit 213, and gears 215 and 217 in order. Accordingly, when the driving pinion 201 rotates in the forward direction F, the fixing unit gear 219 rotates in the backward direction H. It is because, referring to FIG. 5, the fixing belt driving roller 153 should rotate in a backward direction H according to a progressing direction of a printing medium on a simplex printing path SP. A rotation direction may be changed depending on a way of selecting which of the rollers 151, 153 and 155 in the fixing unit 150 may be a driving roller and a driven roller.

The fixing unit power transmission unit 213 may be provided as a latch gear, which includes the first gear train 213*a* and a second gear train 213*b* on a latch gear shaft 213*c*. The first gear train 213*a* transmits power to the gear 215 when the driving pinion 201 rotates in the forward direction F, and blocks power thereto when the driving pinion 201 rotates in the backward direction H. That is, the fixing unit 150 is driven only when the driving pinion 201 rotates in the forward direction F. Alternatively, the fixing unit power transmission unit 213 may be provided as an other power transmission unit such as a one-way gear, an electronic clutch, etc.

Meanwhile, power transmitting path to the discharging roller 163 by the power transmitting apparatus 200 is as follows.

Referring to FIGS. 4 and 5, power transmission from the driving pinion 201 to a discharging gear 227 connected to a shaft of the discharging roller 163 is performed via the gears 202, 211 and 212, the second gear train 213*b* of the fixing unit power transmission unit 213, and gears 221, 223 and 225 in order. Accordingly, the discharging gear 227 rotates in the same direction as the driving pinion 201 rotates. That is, the discharging gear 227 rotates in the forward or backward direction as the driving pinion 201 rotates in the forward or backward direction. Thus, in order to rotate the discharging roller 163 in the forward or backward direction, a rotation direction of the shaft of the first driving source 183 is controlled to rotate the driving pinion 201 in the forward or backward direction.

The image forming apparatus 100 according to the present exemplary embodiment may further include at least one of a second driving source 185 and a third driving source 187.

The second driving source 185 may drive the photosensitive bodies 135Y, 135M, 135C and 135K of the developing units 130Y, 130M, 130C and 130K, respectively. Referring to FIG. 5, the photosensitive bodies 135Y, 135M, 135C and 135K may be transmitted with power from the second driving source by a coupling C. As necessary, the second driving source 185 may be provided to drive the pick up rollers 113 and 119, the registration roller 114, the duplex roller 115 and the transport belt driving roller 127. As the photosensitive bodies 135Y, 135M, 135C and 135K and the rollers 113, 114, 115 and 127 have the same rotation direction, power transmitting path from the second driving source 185 may be easily performed by a proper combination of gears, which will not be explained. The second driving source 185 may selectively drive the photosensitive body 135K and/or the photosensitive bodies 135Y, 135M, and 135C. Accordingly, the developing roller gear 208K and the photosensitive body 135K can be simultaneously driven by the first driving source 183 and the second driving source 185.

The third driving source 187 may be provided to drive only the color developing unit 130Y, 130M and 130C to store color developing agents among the developing units 130Y, 130M, 130C. The third driving source 187 are provided to drive the developing rollers 133Y, 133M and 133C, the supplying roller 131Y, 131M and 131C and the agitators (not illustrated) which are accommodated in the color developing units 130Y, 130M and 130C except for the photosensitive bodies 135Y, 135M and 135C. As necessary, the third driving source 187 may drive only a portion of the foregoing components.

The developing rollers 133Y, 133M and 133C, the supplying rollers 131Y, 131M and 131C and the agitators (not illustrated) agitate, supply to the photosensitive bodies 135Y, 135M and 135C, or charge with electricity the developing agents stored in the color developing units 130Y, 130M and 130C, thereby causing stress to the developing agent.

The second and third driving sources 185 and 187 may be provided as a brushless direct current (BLDC) motor. Alternatively, the driving sources 185 and 187 may be provided as other types of electric motors.

As illustrated in FIGS. 2 and 3, the image forming apparatus 100 according to the present exemplary embodiment may further include a duplex printing sensor 170.

The duplex printing sensor 170 senses whether a printing medium progresses along the duplex printing path DP. That is, the duplex printing sensor 170 senses whether the printing medium progresses to the duplex guide 118.

In addition, the duplex printing sensor 170 may be provided to also sense whether the printing medium passes the fixing unit 150 for cost reduction and a simple structure, as necessary. Namely, one sensor is provided to sense a printing medium passing the fixing unit 150 and progressing to the duplex printing path DP, which operation and structure is as follows.

Figure 3A:
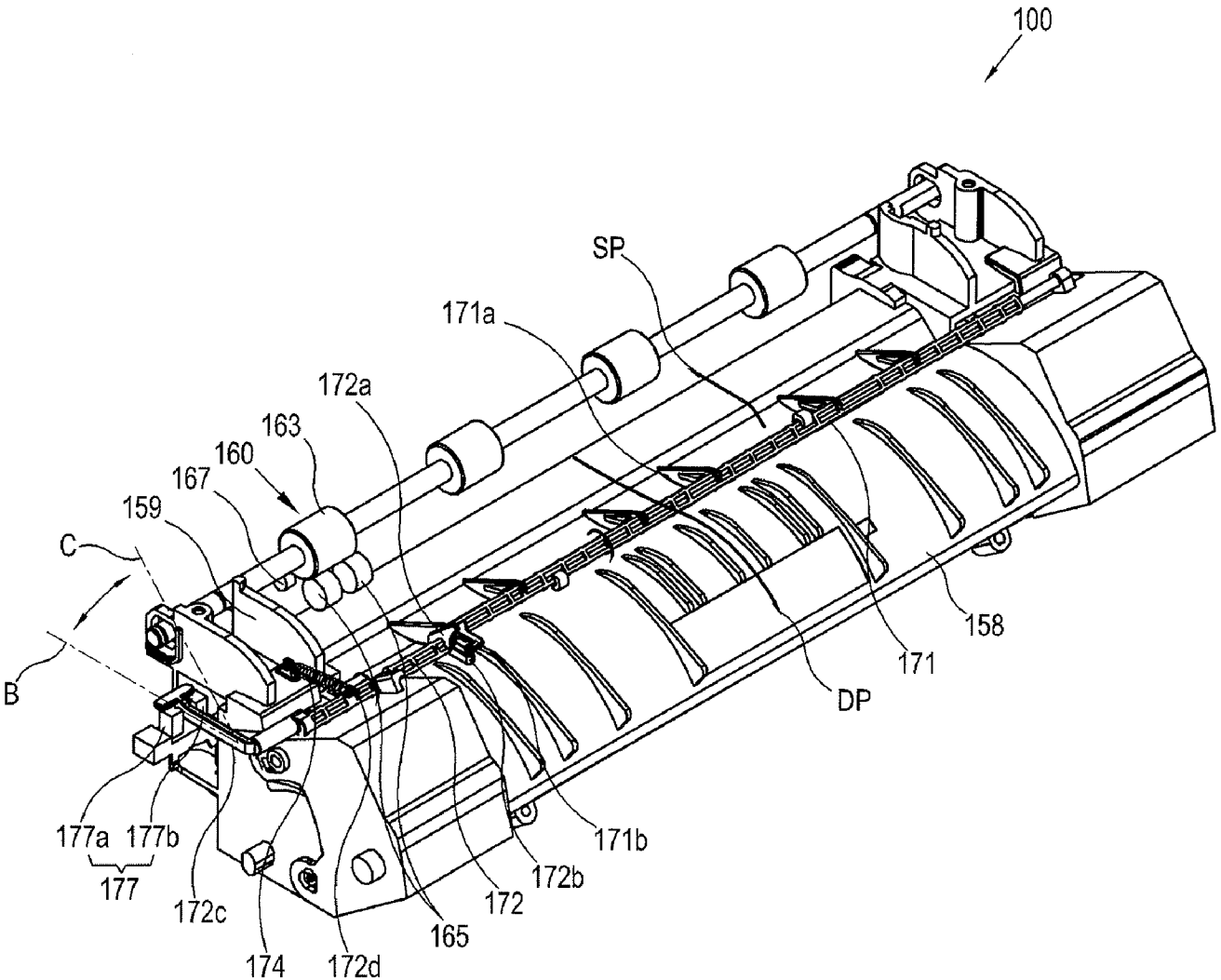
FIG. 3A is a perspective view illustrating a main portion of the image forming apparatus according to the exemplary embodiment of the present general inventive concept.
Figure 3B:
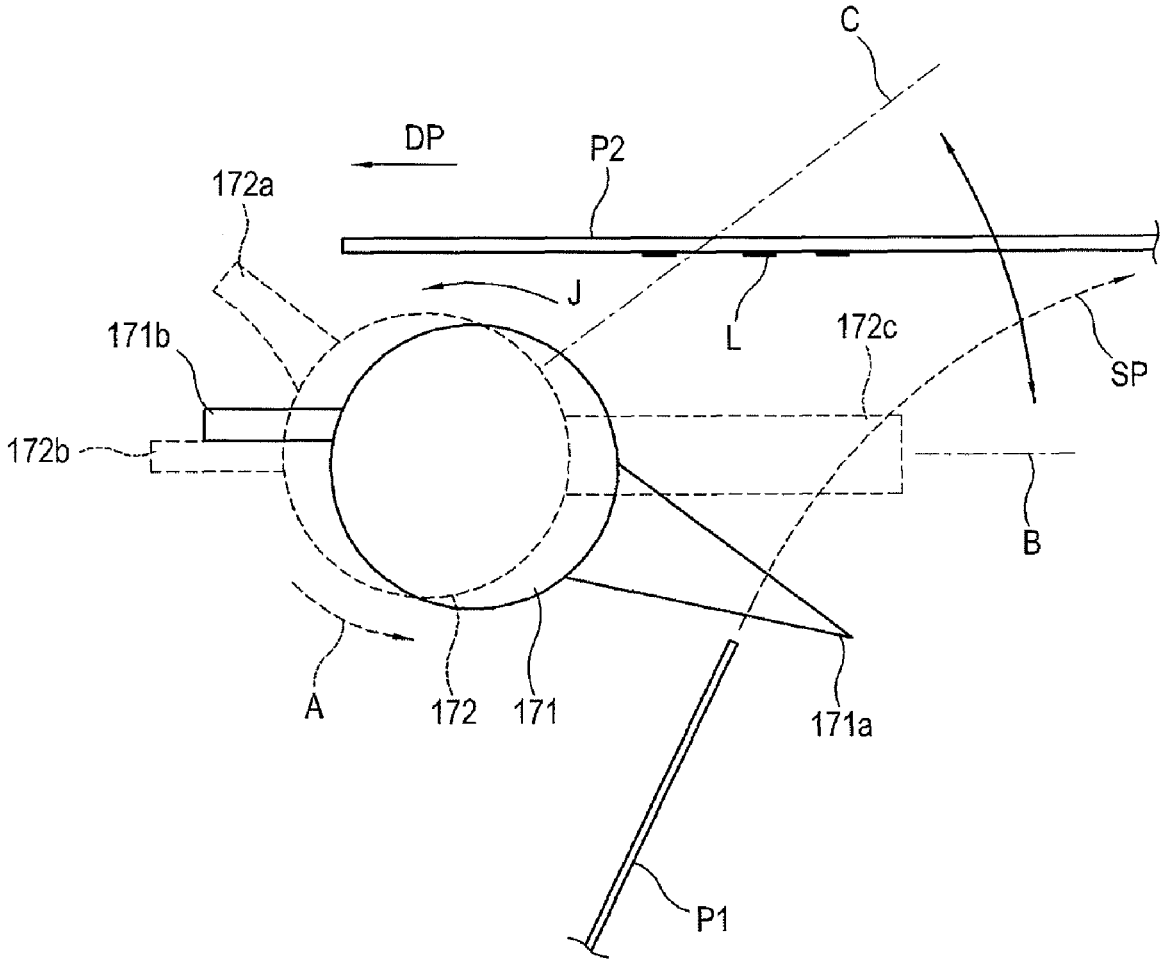
FIG. 3B illustrates an operation process of a duplex printing sensor in the image forming apparatus according to the exemplary embodiment of the present general inventive concept.

As illustrated in FIGS. 2, 3A and 3B, the duplex printing sensor 170 includes a first lever 171, a second lever 172, an elastic member 174 and a light sensor 177.

The first lever 171 and the second lever 172 are rotatably supported by the fixing frame 159. The first lever 171 and the second lever 172 may be either concentric or eccentric in their axis of rotation.

The first lever 171 includes a plurality of first lever protrusions 171*a* to contact a leading edge of a printing medium passing the fixing unit 150 and a plurality of first interlocking-rotating protrusions 171*b* to rotate the second lever 172 interlocking with rotation of the first lever 171.

The second lever 172 includes a second lever protrusion 172*a*, a second interlocking-rotating protrusion 172, a bent portion 172*c* and a stopper 172*d*.

The second lever protrusion 172*a* rotates the second lever 172 at the discharging roller 163 by contacting a printing medium which progresses on the duplex printing path DP.

The second interlocking-rotating protrusion 172*b* is provided to rotate the second lever 172 interlocked with rotation of the first lever 171 but not to interlock the first lever 171 with rotation of the second lever 172. Thus, the second interlocking-rotating protrusions 172*b* are provided under the first interlocking-rotating protrusions 171*b* to contact each other, as illustrated in FIG. 3B. Accordingly, when the first lever 171 rotates in a direction of J, the first interlocking-rotating protrusions 171*b* press the second interlocking-rotating protrusions 172*b* downward, and thus the second lever 172 rotates in the direction of J interlocked with the first lever 171.

However, when the second lever protrusions 172*a* are pressed by a printing medium P2 progressing along the duplex printing path DP to rotate the second lever 172 in a direction of A, the second interlocking-rotating protrusions 172*a* are separated from the first interlocking-rotating protrusions 171*b*, and thus does not rotate the first lever 171 without interlocking, but only the second lever 172 rotates. Accordingly, it is prevented that the first level protrusions 171*a* of the first lever 171 scratch a printing surface L of the printing medium P2 progressing along the duplex printing path DP, if the first lever 171 rotates interlocking with the second lever 172.

Meanwhile, the bent portion 172*c* blocks light from a light emitting portion 177*a* of the light sensor 177 from reaching a light receiving portion 177*b*, or releases the block of light.

The second lever 172 may be formed in a single body with the protrusions 172*a*, 172*b* and 172*d* including the bent portion 172*c* considering manufacturing efficiency.

The elastic member 174 returns the first lever 171 and the second lever 172 to their original positions when a printing medium no longer contacts with the printing medium after the printing medium progresses by rotation and contacts one of the first lever 171 and the second lever 172. That is, the elastic member 174 applies elastic force to the first lever 171 or the second lever 172 in a direction against a rotation of the first lever 171 and the second lever 172. Referring to FIG. 3A, one end portion of the elastic member 174 is connected to the stopper 172*d* of the second lever 172, and the other end thereof is connected to the fixing frame 159.

The light sensor 177, referring to FIG. 3A, is disposed at an end portion of the bent portion 172*c* of the second lever 172.

The light sensor 177 includes the light emitting portion 177*a* and the light receiving portion 177*b*, and the bent portion 172*c* of the second lever 172 is interposed therebetween. Accordingly, the bent portion 172*c* of the second lever 172 is at a blocking position B where light from the light emitting portion 177*a* is blocked from reaching the light receiving portion 177*b* before a printing medium contacts the first lever 171 or the second lever 172, as illustrated in FIGS. 3A and 3B.

Meanwhile, when the first lever 171 or the second lever 172 contacts the printing medium, the bent portion 172*c* rotates to be at a releasing position C spaced away from the blocking position B, and thus light from the light emitting portion 177*a* reaches the light receiving portion 177*b*.

The light sensor 177 may be provided to sense rotation of the first lever 171 instead of rotation of the second lever 172. Accordingly, the bent portion 172*c* may be provided on the first lever 171. Alternatively, other types of sensors such as a contact sensor may be used to sense rotation of the first lever 171 or the second lever 172.

Referring to FIG. 6, the image forming apparatus 100 according to the present exemplary embodiment further includes a controller 190.

The controller 190 not only controls the entire components in the image forming apparatus 100 to form an image on a printing medium, but also performs the following operation.

The image forming apparatus 100 may further include an interface 240 which is connected to a host device (not illustrated) to transmit/receive data to/from. The interface 240 may communicate with the host device through a network, e.g., a parallel interface, a serial interface such as a universal serial bus, a local area network (LAN), etc.

The controller 190 may further include a printing mode determining unit 193 which determines a printing mode of a data transmitted through the interface 240.

The printing mode determining unit 193 determines whether a data transmitted through the interface 240 is to be printed in a duplex printing mode where a data is printed on opposite sides of a printing medium or a simplex printing mode where a data is printed on one side of the printing medium. Also, the printing mode determining unit 193 further determines whether data is to be printed in a color printing mode by driving a plurality of color developing units with color developing agents or in a black and white printing mode by driving only a mono developing unit with a black developing agent.

In the simplex printing mode, the controller 190 controls the first driving source 183 so that the discharging roller 163 rotates in the forward direction F to discharge a printing medium to the outside. Further, in the black and white printing mode, as the controller 190 does not need to drive the color developing units 130Y, 130M and 130C, i.e., a second rotating body 131Y, 131M, 131C, 133Y, 133M and 133C accommodated in the color developing units 130Y, 130M and 130C, the third driving source 187 may be off. Thus, only the third driving source 187 is controlled to control the entire operations of the color developing units 130Y, 130M and 130C and suppresses unnecessary operations thereof, thereby reducing stress on the developing agent. Further, power consumption may be reduced and driving noises may be decreased.

In the duplex printing mode, the controller 190 controls the duplex printing sensor to sense that simplex printing is completed when a printing medium printed one side thereof along the simplex printing path SP passes the fixing unit 150 to contact with the first lever protrusions 171*a*. The controller 190 controls the first driving source 183 to rotate the discharging roller 163 in the forward direction F until a printing medium printed completely in its one side passes the fixing unit 150 and a trailing edge of the printing medium is caught between the discharging roller 163 and the idle rollers 165 and 167. That is, the shaft of the first driving source 183 is rotated in the forward direction F.

The catching point may be estimated considering a sensing signal of the duplex printing sensor 170 and a transporting speed of the printing medium.

In detail, a light receiving point when the light receiving portion 177*b* of the light sensor 177 of the duplex printing sensor 170 starts to receive light is a point when a leading edge of a printing medium printed in its one side contacts the first lever protrusions 171*a* to start to pass the fixing unit 150. Further, a light non-receiving point when the light receiving portion 177*b* starts not to receive light is a point when the trailing edge of the printing medium completely passes the fixing unit 150, more particularly, the duplex printing sensor 170. Thus, the catching point is estimated as a time after a predetermined time from the light non-receiving point considering a transporting speed of the printing medium. As necessary, the light non-receiving point may be indicated as the catching point.

Then, the controller 190 controls the first driving source 183 to rotate the discharging roller 163 in the backward direction after the catching point. That is, the shaft of the first driving source 183 is rotated in the backward direction. Accordingly, the printing medium printed on its one side is transported by the duplex guide 118 in an opposite direction to the direction where the printing medium has been transported along the simplex printing path SP.

Meanwhile, as the shaft of the first driving source 183 is rotated backward, power from the first driving source 183 is blocked to a first rotating body which is accommodated in the mono developing unit 130K, such as the developing roller 133K, the supplying roller 131K and the agitator (not illustrated) except for the photosensitive body 135K, and the fixing unit 150 by the power transmission units 205 and 213. Thus, as the mono developing unit 130K and the fixing unit 150 are not driven while the printing medium progresses along the duplex printing path DP, stress on the developing agent in the mono developing unit 130K may be reduced. Moreover, a driving load given to the first driving source 183 may be decreased. In addition, the fixing unit 150, the mono developing unit 130K and the discharging roller 163 are all driven by the first driving source 183, thereby simplifying a power structure and reducing a manufacturing cost.

If the printed side of the printing medium is transported along the duplex printing path DP by the backward rotation of the discharging roller 163, the light receiving portion 177*b* starts to receive light from the light emitting portion 177*a* again after a contacting point when the leading edge of the printing medium contacts with the second lever protrusions 172*a*.

Then, the light receiving portion 177*b* does not receive light after a contact releasing point when the trailing edge of the printing medium no longer contacts with the second lever protrusions 172*a*. Accordingly, a sensed result by the duplex printing sensor 170 illustrates that the printing medium completely passes through the discharging unit 160 to progress along the duplex guide 118.

Thus, the controller 190 may control the first driving source 183 to stop operating during all or a portion of a period of time from the contact releasing point after rotating the discharging roller 163 in the backward direction to a point when the printing medium passes again between the mono developing unit 130K and the transfer roller 140. It is because that the fixing unit 150, the mono developing unit 130K and the discharging roller 163 do not need to be driven within the period of time.

As necessary, the controller 190 may control the first driving source 183 to rotate the shaft thereof in the forward direction at the contact releasing point, more accurately, at any time within a period of time from when the printing medium progressing along the duplex printing path DP is released from the discharging roller 163 until the printing medium is caught by the registration roller 114. The controller 190 may rotate the first driving source 183 in the forward direction any time after the printed side of the printing medium passes the registration roller 114 and before it passes between the mono developing unit 130K and the transfer roller 140.

As it is unnecessary to drive the color developing units 130Y, 130M and 130C while the discharging roller 163 rotates in the backward direction, the controller 190 may stop operating the third driving source 187. If the second driving source 185 drives all the photosensitive bodies 135Y, 135M, 135C and 135K with only the transport unit 120, the controller 190 may stop operating the second driving source 185. Accordingly, both the color developing units 130Y, 130M and 130C and the mono developing unit 130K do not operate while the discharging roller 163 rotates in the backward direction, thereby decreasing stress on the developing agents in the developing units 130Y, 130M, 130C and 130K and reducing power consumption.

The controller 190 controls the third driving source 187 not to operate during all or a portion of a time period from the time when the printed side of the printing medium is released from the fixing unit 150 to the time when the printing medium transported along the duplex guide 118 is caught by the registration roller 114, that is, while the printing medium progresses along the duplex printing path DP. It is because that the color developing units 130Y, 130M and 130K do not need to operate. If the second driving source 185 drives all the photosensitive bodies 135Y, 135M, 135C and 135K only with the transport unit 120, the controller 190 controls the second driving source 185 to be off.

Meanwhile, in the duplex printing mode, the printing mode determining unit 193 determines whether to print in a black and white printing mode or in a color printing mode for respective front and back sides of the print medium. If one side of the printing medium is determined to be printed in the black and white printing mode, the third driving source 187 may not be driven while the corresponding side is printed, For example, if one side of a printing medium is to be printed in the color printing mode while the other side is to be printed in the black and white printing mode, the third driving source 183 may not be driven from the time when printing is completed on one side of the printing medium and is transported along the duplex printing path DP by the backward rotation of the discharging roller 163, Also, a trailing edge of the printing medium is discharged from the discharging roller 163 to the time when the other side of the printing medium completely printed on is discharged to the outside. Thus, through distinguishing a black and white printing mode or a color printing mode, stress on developing agents and power consumption may be reduced if it is determined to print a printing medium in the black and white printing mode, by not driving the third driving source 183.

Meanwhile, the controller 190 may control the third driving source 187 not to operate if the printing mode determining unit 193 determines that data received through the interface 240 is to be printed in the black and white printing mode. Black and white printing may be performed only by the first driving source 183 and the second driving source 185.

Figure 7:
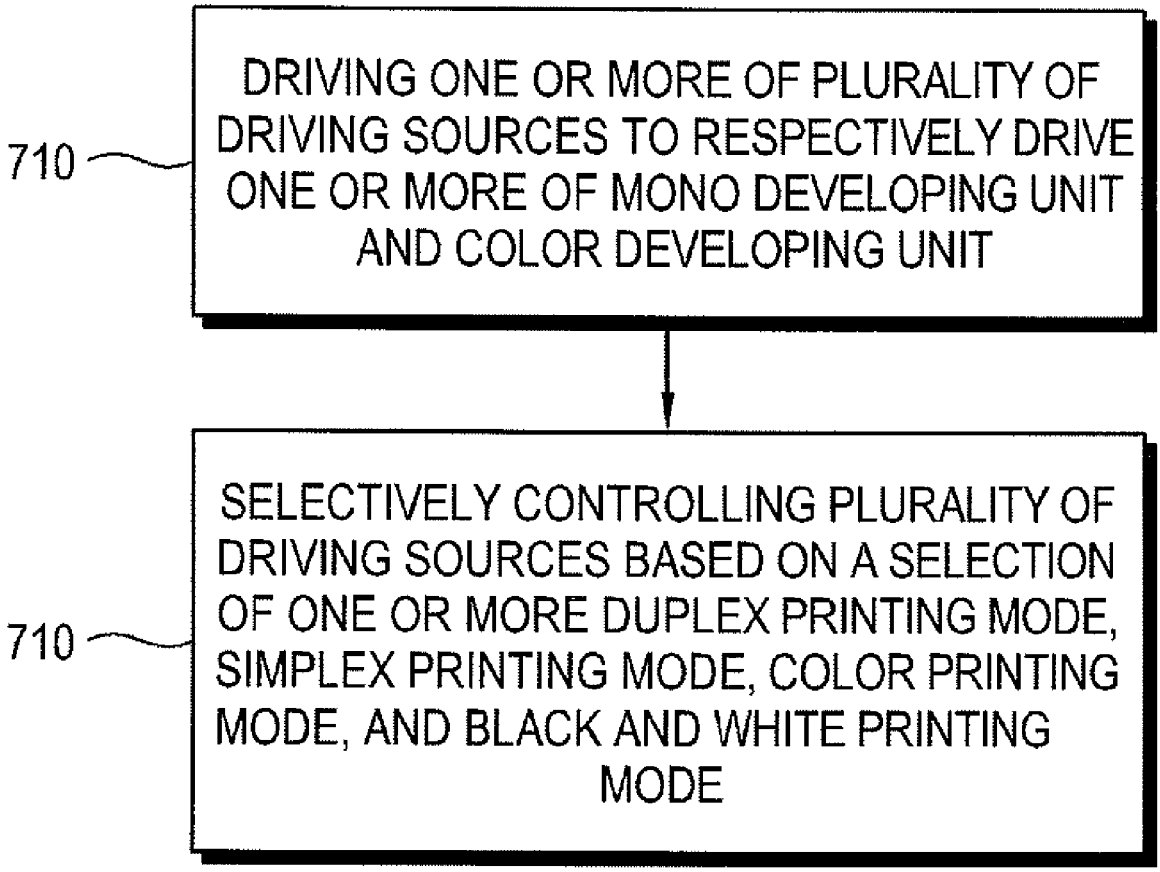
FIG. 7 is a flowchart illustrating a method of operating an image forming apparatus according to an embodiment of the present general inventive concept.

FIG. 7 is a flowchart illustrating a method of operating an image forming apparatus according to an embodiment of the present general inventive concept. Referring to FIG. 7, in operation 710, driving one or more of a plurality of driving sources to respectively drive one or more of a mono developing unit and a color developing unit. In operation 720, selectively controlling the plurality of driving sources based on a selection of one or more of a duplex printing mode, a simplex printing mode, a color printing mode, and a black and white printing mode.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, various embodiments of the present general inventive concept provides an image forming apparatus that decreases a number of driving sources with a simple structure in transmitting power.

Various embodiments of the present general inventive concept also provides an image forming apparatus that reduces a driving noise, a manufacturing cost and power consumption by decreasing the number of a driving source.

In an image forming apparatus according to various embodiments of the present general inventive concept, as a separate driving source is provided to drive a color developing unit that is not driven in black and white printing, stress on a color developing agent is decreased.

Further, in an image forming apparatus according to various embodiments of the present general inventive concept, as a fixing unit, a mono developing unit and a discharging roller are driven by a single driving source, the driving source is not driven while a printing medium discharged from the discharging roller is being transported on a duplex printing path, stress on a black and white developing agent is reduced.

The present general inventive concept provides an image forming apparatus of a simple driving structure and compact in size.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a plurality of developing units to form an image using a developing agent on one side of a printing medium transported along a simplex printing path, each of the developing units arranged to store different colors of developing agents and comprising a photosensitive body, a developing roller to develop the photosensitive body with the developing agent, and an agitator to agitate the developing agent;

a fixing unit to fix the developing agent on the printing medium;

a discharging roller to discharge the printing medium that passes the fixing unit;

a first driving source to drive the developing unit, the fixing unit and the discharging roller, and a second driving source to rotatably drive all the photosensitive bodies of the developing units.

2. The image forming apparatus according to claim 1, further comprising:

a developing unit power transmission unit to selectively transmit power from the first driving source to the developing unit.

3. The image forming apparatus according to claim 1, further comprising:

a fixing unit power transmission unit to selectively transmit power from the first driving source to the fixing unit.

4. The image forming apparatus according to claim 1, wherein the developing units comprise:

a mono developing unit disposed adjacent to the fixing unit among the developing units and to store a black developing agent; and the first driving source to drive the developing roller and the agitator which are in the mono developing unit.

5. The image forming apparatus according to claim 1, further comprising:

a plurality of transfer rollers disposed parallel with the photosensitive bodies with a printing medium interposed between the transfer rollers and the photosensitive bodies; and a transport unit to transport the printing medium between the photosensitive bodies and the transfer rollers and is driven by the second driving source.

6. The image forming apparatus according to claim 1, wherein the developing units comprise:

a color developing unit to store a color developing agent; and the image forming apparatus further comprising:

a third driving source to drive the developing roller and the agitator which are in the color developing unit.

7. The image forming apparatus according to claims 6, further comprising:

a duplex guide to guide the printing medium from the discharging roller to the developing unit so that an other side of the printing medium is to be printed, wherein the discharging roller is provided to be rotatable in forward and backward directions to transport the printing medium to the duplex guide.

8. The image forming apparatus according to claim 7, further comprising:

a duplex printing sensor to sense whether the printing medium is transported to the duplex guide.

9. The image forming apparatus according to claim 8, wherein the duplex printing sensor senses whether the printing medium passes the fixing unit.

10. The image forming apparatus according to claim 9, wherein the duplex printing sensor comprises:

a first lever interposed between the fixing unit and the discharging roller to rotate while contacting a printing medium which passes the fixing unit;

a second lever to rotate by interlocking with the first lever and rotates while contacting a printing medium which progresses by a backward rotation of the discharging roller; and a sensor to sense a position of at least one of the first and second levers.

11. The image forming apparatus according to claim 8, further comprising:

a controller to control the first driving source to rotate the discharging roller in forward and backward directions according to a result sensed by the duplex printing sensor in a duplex printing mode.

12. The image forming apparatus according to claim 7, further comprising:

a pair of registration rollers disposed in front of the developing units with respect to the simplex printing path and driven by the second driving source; and a controller to control at least one of the second and third driving sources not to operate after the printing medium completely passes the fixing unit, before the printing medium is caught again by the registration rollers.

13. The image forming apparatus according to claim 7, further comprising:

a controller to control at least one of the second and third driving sources not to operate while the discharging roller rotates in a backward direction, if duplex printing is requested.

14. The image forming apparatus according to claim 6, further comprising:

a controller to determine whether printing data for an other side of a printing completed side of the printing medium corresponds to data to be printed in a black and white printing mode in a duplex printing mode.

15. The image forming apparatus according to claim 7, further comprising a controller to determine whether a printing data corresponds to a data to be printed in a black and white mode and controls the third driving source not to operate if the printing data corresponds to the data to be printed in the black and white mode.

16. An image forming apparatus, comprising:

a developing unit comprising:

a mono developing unit which comprises a first photosensitive body, a developing agent storage unit to store a black developing agent, and a first rotating body to supply the black developing agent to the first photosensitive body, and a color developing unit which comprises a second photosensitive body, a developing agent storage unit to store a color developing agent, and a second rotating body to supply the color developing agent to the second photosensitive body;

a fixing unit to fix the black and color developing agents on a printing medium;

a discharging roller to discharge the printing medium passing the fixing unit; and a driving source unit comprising:

a first driving source to drive the first rotating body, the fixing unit and the discharging roller;

a second driving source to drive the first and second photosensitive bodies; and a third driving source to drive the second rotating body.

17. An image forming apparatus, comprising:

a developing unit having a mono developing unit and a color developing unit; a plurality of driving sources to respectively drive one or more of the mono developing unit and the color developing unit according to a printing mode including a duplex printing mode, a simplex printing mode, a color printing mode, and a mono printing mode;

a fixing unit to fix the black and color developing agents on a printing medium; and a discharging roller to discharge the printing medium passing the fixing unit, wherein:

the mono developing unit includes a first photosensitive body, a developing agent storage unit to store a black developing agent, and a first rotating body to supply the black developing agent to the first photosensitive body;

the color developing unit includes a second photosensitive body, a developing agent storage unit to store a color developing agent, and a second rotating body to supply the color developing agent to the second photosensitive body; and the plurality of driving sources comprise:

a first driving source to drive the first rotating body, the fixing unit and the discharging roller;

a second driving source to drive the first and second photosensitive bodies; and a third driving source to drive the second rotating body.

* * * * *